United States Patent [19]

Nercessian

[11] 4,281,282

[45] Jul. 28, 1981

[54] HIGH POSITIVE AND NEGATIVE VOLTAGES PROGRAMMED BY A LOW VOLTAGE RETURNED TO COMMON

[75] Inventor: Sarkis Nercessian, Flushing, N.Y.

[73] Assignee: Kepco, Inc., Flushing, N.Y.

[21] Appl. No.: 82,094

[22] Filed: Oct. 5, 1979

[51] Int. Cl.[3] ..... G05F 1/10

[52] U.S. Cl. ..... 323/350; 330/99; 330/117

[58] Field of Search ..... 323/22 T, 23, 25; 330/98–100, 117, 148, 301, 310

[56] References Cited

U.S. PATENT DOCUMENTS

| | | | |
|---|---|---|---|
| 3,528,024 | 9/1970 | Barber | 330/117 |
| 3,571,604 | 3/1971 | LaPorta | 323/23 X |
| 3,694,662 | 9/1972 | Grygera et al. | 323/25 X |
| 3,849,665 | 11/1974 | Wells | 323/23 X |

*Primary Examiner*—William M. Shoop
*Assistant Examiner*—Peter S. Wong
*Attorney, Agent, or Firm*—Alfred W. Barber

[57] ABSTRACT

Two high voltage power supplies having negative outputs with respect to common are combined to provide positive as well as negative output with respect to common. An operational preamplifier is used as an inverter. The combination includes provision for programming by means of a voltage returned to common making the system compatible with Conventional remote control systems.

7 Claims, 1 Drawing Figure

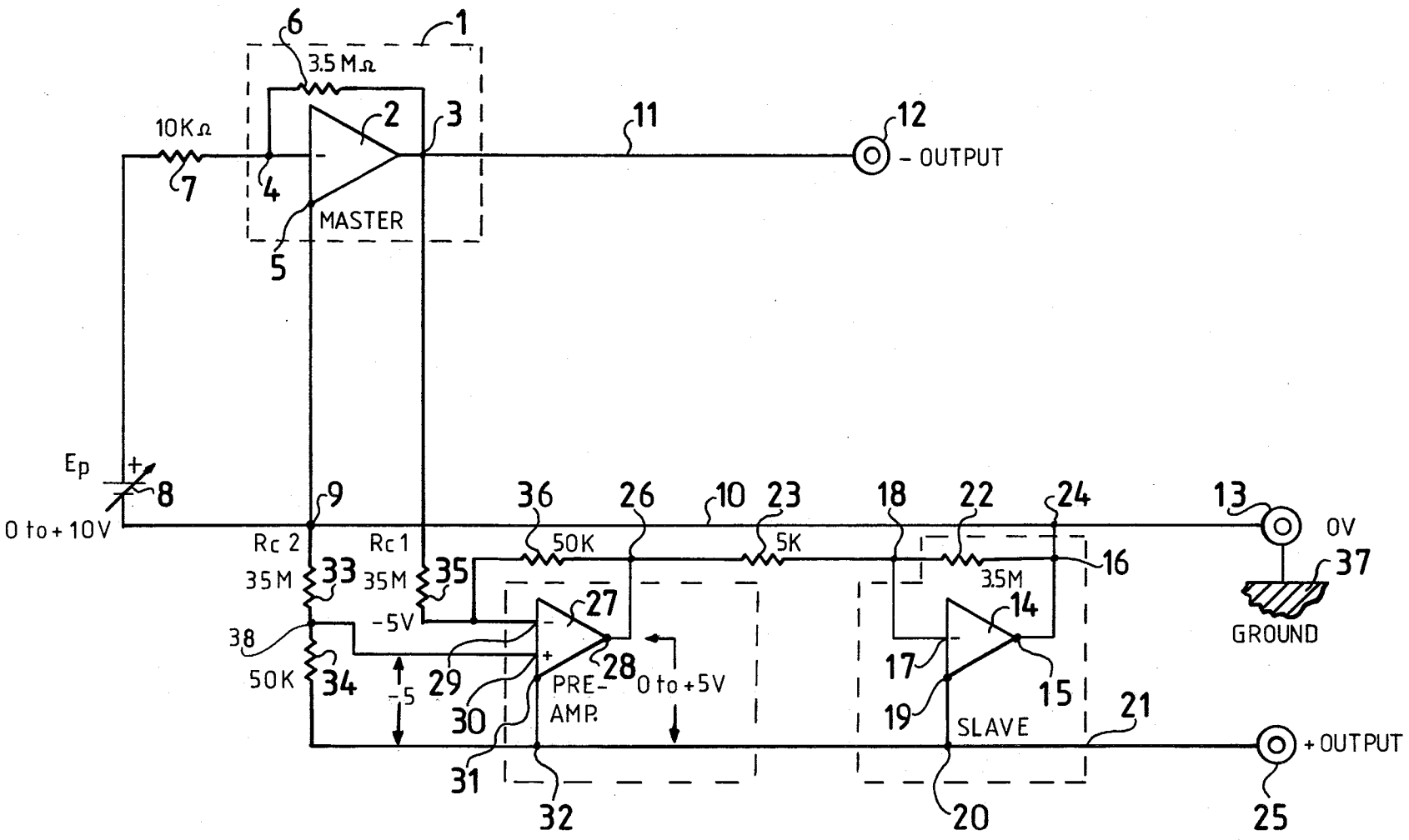
- OUTPUT
+ OUTPUT
0V
GROUND
MASTER
SLAVE
PRE-AMP.
3.5 MΩ
10KΩ
Ep
0 to +10V
0 to +5V
-5V
Rc1 35M
Rc2 35M
50K
5K
3.5M
1
2
3
4
5
6
7
8
9
10
11
12
13
14
15
16
17
18
19
20
21
22
23
24
25
26
27
28
29
30
31
32
33
34
35
36
37
38

HIGH POSITIVE AND NEGATIVE VOLTAGES PROGRAMMED BY A LOW VOLTAGE RETURNED TO COMMON

PRIOR ART

Master/slave programmable power supplies are often used to provide both positive and negative voltages with respect to common or ground. In two prior art patents, namely U.S. Pat. Nos. 3,275,927 and 3,581,224 master/slave programmable power supplies are shown and described. However, in both of the above cases the programming voltage is returned to the negative output. This precludes the use of such combinations in remotely controlled systems since in such systems the programming voltage or current must be referenced to common. It would be completely impractical in a high voltage power supply combination where the negative return could be a thousand or more volts below ground.

In U.S. Pat. No. 3,528,024 circuits are shown (FIGS. 2, 3 and 4) in which the programming voltage is returned or referenced to common. However, in this disclosure there is no provision for gain in the power supplies being programmed so that the output voltage is equal to the input or programming voltage. Thus, it is obviously impractical to provide high voltage outputs, say, 1000 volts or more. Programming voltages in remote control systems are typically 0–10 volts.

THE PRESENT INVENTION

It has been found that by adding an inverting preamplifier to the combination of a master/slave power supply combination that high output voltages both positive and negative with respect to common can be programmed by a conventional low programming voltage returned to common.

Accordingly, it is the main object of the present invention to provide a method of and means for programming two high voltage power supplies in a master/slave configuration from a low voltage programming voltage returned to common (ground).

It is a further object to provide an arrangement of two high voltage power supplies in master/slave configuration which is compatible with remote programming controls.

In the Drawing:

The FIGURE of the drawing is a schematic block diagram of the preferred form of the present invention.

In the FIGURE, master power supply 1 comprises power amplifier 2 having output terminal 3, inverting input terminal 4 and common terminals 5. Since amplifier 2 operates in an operational amplifier mode, its gain is determined by the ratio of feedback resistor 6 to input resistor 7. Thus, with the values shown, amplifier 2 operates with a gain of 350 times. Amplifier 2 is programmed by means of variable voltage 8, variable from 0 to 10 volts. With the full plus 10 volts applied to one end of input resistor 7, the output voltage at output terminal 3 will be minus 3500 volts which in turn is applied to output terminal 12 over connecting lead 11. The programming voltage source 8 is returned to junction point 9 as is the common terminal 5 of amplifier 2. Junction point 9 is connected to the power supply system common output terminal 13 over lead 10. Common terminal 13 is connected to ground 37. The master power supply so far described can be programmed by variable programming voltage 8 to provide from 0 to −3500 volts between common terminal 13 and negative terminal 12. An equivalent programming can be accomplished when a remote 0–10 volt programming voltage is substituted for source 8.

The slave power supply comprises a main amplifier 14 having an output terminal 15, an inverting input terminal 17 and a common terminal 19. Output terminal 15 is connected to common line 10 at junction point 24 and to feedback resistor 22 at junction point 16. Feedback resistor 22 is connected to input resistor 23 at junction point 18 and junction point 18 is connected to input terminal 17. Common terminal 19 is connected to positive output line 21 at junction point 20 and positive output line 21 is connected to positive output terminal 25. Now the gain of main amplifier 14, an operational power amplifier, is equal to the resistance of the feedback resistor 22, shown as 3.5 megohms, divided by the resistance of the input resistor 23, shown as 5 K (5 thousand) ohms, or 700 times the input voltage. Thus, if the input voltage applies between junction point 26 and positive line 21 is programmed from 0 to +5 volts, the output voltage between common line 10 and positive line 21 will be programmed from 0 to +3500 volts. The purpose of the inverting preamplifier 27 is to provide this 0 to 30 5 volts derived from the master power supply output so that the positive output will track the negative output and both will be under the control of programming voltage 8.

Inverting preamplifier 27 is an operational amplifier including an output terminal 28, an inverting input terminal 29, a non-inverting input terminal 30 and a common terminal 31. Common Terminal 31 is connected to positive line 21 at junction point 32. Feedback resistor 36 is connected between output 28 and input 29. Resistor 35 is connected between negative line 11 at junction point 3 and inverting input 29. A divider comprising resistors 33 and 34 is connected between common line 10 at junction point 9 and positive line 21 at junction point 32. The junction point 38 between resistors 33 and 34 is connected to non-inverting input 30. In this configuration, preamplifier 27 is operated as a differential amplifier. As such it adjusts its output in such a way as to cause the voltages at its two input terminals to be equal.

To illustrate this balancing function, assume that the negative output is −3500 volts and that the positive output as controlled by the preamplifier is +3500 volts. With resistors 33 and 34 as shown equal to 35 megohms and 50 kilohms respectively, the junction point 38 and hence the non-inverting input 30 will be −5 volts with respect to positive line 21. With resistor 35 equal to 35 megohms and resistor 36 equal to 50 kilohms, inverting input 29 will be −5 volts and the inverted output at output terminal 28 will be +5 volts. Now, as stated above, +5 volts at junction point 26 will program main amplifier 14 to provide 3500 volts output and the master/slave system is in balance. The same procedure may be carried out to show that the positive output tracks the negative output. If the input programming voltage 8 is reduced from its maximum of 10 volts, all voltages programmed thereby will be reduced proportionally and the positive and negative outputs will track all the way to zero following the pattern set forth above.

While the preferred form of the invention has been shown and described, modifications are possible within the spirit and scope of the invention as set forth in particular in the appended claims.

I claim:

1. In a master/slave power supply configuration, the combination of;

a pair of high voltage programmable power supplies of like output polarity;

a common line;

one of said power supplies connected between said common line and an output line of predetermined polarity;

a source of programming voltage connected between said common line and the programming input of the latter said power supply for programming the voltage on said output line;

the second of said power supplies connected between said common line and a second output line of opposite polarity to said predetermined polarity;

and an inverting preamplifier coupled between said first output line and the programming input of said second power supply;

whereby said second output line is programmed in accordance with the magnitude of the voltage on the first said output line and of opposite polarity.

2. A master/slave power supply combination as set forth in claim 1, and wherein said first and second power supplies are high voltage operational power supplies.

3. A master/slave power supply combination as set forth in claim 1, and wherein said inverting preamplifier is an operational amplifier.

4. A master/slave power supply combination as set forth in claim 1, and wherein said preamplifier coupling is high resistance means.

5. A master/slave power supply combination as set forth in claim 1 and wherein said first said output line polarity is negative with respect to said common line.

6. A master/slave power supply combination as set forth in claim 1, and wherein the voltages on said first and second output lines are equal and of opposite polarity.

7. A master/slave power supply combination as set forth in claim 1, and wherein said preamplifier is connected to compare the outputs on said two output lines.

* * * * *